US007909541B1

(12) United States Patent
Beck, III et al.

(10) Patent No.: US 7,909,541 B1
(45) Date of Patent: Mar. 22, 2011

(54) APPARATUS AND METHOD FOR IMPROVED GROUT CONTAINMENT IN POST-GROUTING APPLICATIONS

(75) Inventors: August H. Beck, III, San Antonio, TX (US); Philip G. King, San Antonio, TX (US)

(73) Assignee: Synchro Patents, Inc., San Antonio, TX (US)

( * ) Notice: Subject to any disclaimer, the term of this patent is extended or adjusted under 35 U.S.C. 154(b) by 48 days.

(21) Appl. No.: 12/288,906

(22) Filed: Oct. 24, 2008

(51) Int. Cl.
*E02D 5/30* (2006.01)
*E02D 5/62* (2006.01)

(52) U.S. Cl. ..... 405/239; 405/236

(58) Field of Classification Search ..... 405/248, 405/239, 231, 232, 233, 235, 240, 249, 229, 405/230, 236

See application file for complete search history.

(56) References Cited

U.S. PATENT DOCUMENTS

| | | | | | |
|---|---|---|---|---|---|
| 2,130,047 | A | * | 9/1938 | Upton | 405/251 |
| 3,503,254 | A | | 3/1970 | Menard | |
| 3,630,037 | A | * | 12/1971 | Howard | 405/232 |
| 3,633,408 | A | | 1/1972 | Johnston, Jr. | |
| 3,772,911 | A | | 11/1973 | Ruppeneit et al. | |
| 3,793,844 | A | | 2/1974 | Chelminski | |
| 3,851,484 | A | * | 12/1974 | Steding | 405/233 |
| 4,092,832 | A | * | 6/1978 | Mattson | 405/229 |
| 4,315,429 | A | | 2/1982 | Morozov et al. | |
| 4,458,525 | A | | 7/1984 | Lutenegger et al. | |
| 4,483,197 | A | | 11/1984 | Kellner | |
| 4,598,591 | A | | 7/1986 | Baud | |
| 4,614,110 | A | | 9/1986 | Osterberg | |
| 4,662,213 | A | | 5/1987 | Handy et al. | |
| 4,663,977 | A | | 5/1987 | Vander Heyden | |
| 4,722,407 | A | | 2/1988 | Gindy et al. | |
| 4,787,779 | A | * | 11/1988 | Clark | 405/230 |
| 4,906,140 | A | * | 3/1990 | Clark | 405/230 |
| 4,906,141 | A | | 3/1990 | Massarsch | |
| 5,185,595 | A | | 2/1993 | Friesen | |

(Continued)

FOREIGN PATENT DOCUMENTS

CN 1186890 7/1998

(Continued)

OTHER PUBLICATIONS

Mullins, et al, "Pressure-Grouting Drilled Shaft Tips in Sand", New Technological and Design Developments in Deep Foundations, Geotechnical Special Pub. No. 100, Aug. 2000.

(Continued)

*Primary Examiner* — Frederick L Lagman
(74) *Attorney, Agent, or Firm* — Kirt S. O'Neill; Akin Gump Strauss Hauer & Feld

(57) ABSTRACT

A structural assembly and a method are disclosed for an improved foundation element post-grouting technique incorporating a piston arrangement that consists of a barrel at the base of a pier or pile. Grout is pumped into the barrel via one or more conduits and the pressure from the grout exerts downward pressure on the barrel forcing it into the geomaterial below the foundation element and increasing the load bearing capacity of the foundation element. This assembly and method functions to contain the grout within the target grout area beneath the foundation element while simultaneously providing a means for measuring the strength of the geomaterial below the foundation element and the strain and movement associated with the geomaterial and the pier or pile.

34 Claims, 6 Drawing Sheets

U.S. PATENT DOCUMENTS

| | | | |
|---|---|---|---|
| 5,259,240 | A | 11/1993 | Raines et al. |
| 5,319,959 | A | 6/1994 | Cooper et al. |
| 5,377,548 | A | 1/1995 | Ballivy |
| 5,576,494 | A | 11/1996 | Osterberg |
| 5,608,169 | A | 3/1997 | Fujioka et al. |
| 5,739,435 | A | 4/1998 | Sacks |
| 5,823,718 | A | 10/1998 | Du Plessis |
| 6,371,698 | B1 | 4/2002 | Beck et al. |
| 6,869,255 | B1 | 3/2005 | Beck et al. |
| 6,942,429 | B1 | 9/2005 | Beck et al. |

FOREIGN PATENT DOCUMENTS

| | | |
|---|---|---|
| DE | 1 50 089 | 8/1981 |
| DE | 3424776 | 1/1986 |
| GB | 1 413 160 | 11/1975 |
| GB | 2207944 | 2/1989 |
| JP | 1239221 | 9/1989 |
| JP | 2125015 | 5/1990 |
| RU | 585397 | 12/1977 |

OTHER PUBLICATIONS

Bruce, "Enhancing the Performance of Large Diameter Piles by Grouting", Ground Engineering, May 1986.
Bruce, "Enhancing the Performance of Large Diameter Piles by Grouting", Ground Engineering, Jul. 1986.
"Stage Grouting Preloading of Large Piles on Sand", Proceedings of the Eighth International Conference on Soil Mechanics and Foundation Engineering, (1973).
Stocker, "The Influence of Post-Grouting on the Load-Bearing Capacity of Bored Piles", Improvement of Ground, vol. 1, 1983.
Bruce, et al, Enhancement of Caisson Capacity by Micro-Fine Cement Grouting—A Recent Case History—,Geotechnical Grouting Verification.
Fleming, "The Improvement of Pile Performance by Base Grouting", Proc. Instn. Civ. Engrs. Civ. Engng, 1993, 97, May, 88-93.
Dapp, et al, "Pressure-Grouting Drilled Shaft Tips: Full-Scale Research Investigation for Silty and Shelly Sands".
O'Neill, et al, "Drilled Shafts: Effects of Construction on Performance and Design Criteria", Intl. Conference on Design and Construction of Deep Foundations, Dec. 1994.
Schmertmann, et al, "O-Cell Testing Case Histories Demonstrate the Importance of Bored Pile (Drilled Shaft) Construction Technique", Mar. 1998.
Bauer, "Foundation with Grouted Base Piles Misr International Tower, Cairo, Egypt".
Bauer, "Foundation with Grouted Base Piles United States Embassy, Cairo, Egypt".
Bauer, "Foundation with Grouted Base Piles Steel Plant Jubail/Saudi Arabia".
Bauer, "Foundation with Grouted Base Piles Jeddah-Mecca-Expressway".
Excerpts from technical literature regarding Base Grouted Drilled Shafts.
Meyer, et al "Touchdown for O-Cell Test", Civil Engineering, Feb. 1995.
Piccione, et al, "The Piled Foundations of the Al Gazira Hotel in Cairo".
Doornbos, "Vibration-Free Driven Tubular-Piles".
Sample of FDOT Current Design Details and FDOT Sample Detail Currently in Use.
Lai, "The Effect of Drilled Shaft Bearing Resistance After Post Grouting at Tip", GMEC, May 2001.
Progress Report for "The Effect of Pressure-Grouting Drilled Shaft Tips on Bearing Capacity" project, Jul. 1, 2000—Sep. 30, 2000.
Royal Park Post Grouting Load Test Results, (Sep. 2000).
"The Effect of Pressure-Grouting Drilled Shaft Tips on Bearing Capacity", Jul. 1999—Oct. 1999.
"Case Study the Full—Scale Load Test of Pile Foundations", Proceedings of 8th Conf. on Current Researches in Geotechnical Engineering, Aug. 1999, English Abstract included.
"Case Study of Construction Control for Reversed Circulation Pile", Procdgs. of 8th Conference on Current Researches in Geotechnical Eng., Aug. 1999, English Abstract included.
Executed University of South Florida Research Contract dated Jun. 1, 1999.
Mullins, "The Effect of Pressure-Grouting Drilled Shaft Tips on Bearing Capacity", Florida Dept. of Transportation, May 1998.
Troughton, et al, "Base and Shaft Grouted Piles", Proc. Instn. Civ. Engrs. Geotech. Engng. 1996, 119, Jul. 186-192.
Moh, "Current Deep Foundation Practice in Taiwan and Southeast Asia", Proceedings International Conference on Design and Construction of Deep Foundations, Dec. 1994.
Solera, et al, Predicted and Observed settlement of a Building Founded on Base Grouted Piles in the Thanet Sands, London, Proc. of 10th European Conf. on Soil Mech . . . , 1991.
Santosuosso, et al, "Construction of Pile Foundation of the Postal Cittadel in the Direction Center of Naples", Proc. of 4th European Conf. on Soil Mech . . . , 1991.
Bellini, et al, "The Use of Bounded Fluid Preloading Cells for the Foundation Piles of a Viaduct on the High-Speed Freeway in Naples" Proc. of 4th European Conf . . . , 1991.
Troughton, et al, "The Effects of Changes in Effective Stress on a Base Grouted Pile in Sand", Proc.of 2nd European Conf. on Soil Mech. & Found. Eng., 1989.
Yeats, et al, "The Design and Construction of Large Diameter Base Grouted Piles in Thanet Sand at Blackwall Yard, London", Proc. of 2nd European Conf. on Soil . . . , 1989.
Sherwood, et al, "Base Grouted Piles in Thanet Sands, London", Proc. of 2nd European Conf. on Soil Mech. & Found. Eng., 1989.
Stocker, et al, "The Influence of Post-Grouting on the Load-Bearing Capacity of Bored Piles", Proc. of 8th European Conf. on Soil Mech. & Found. Eng., 1983.
Littlejohn, et al, "Improvement in Base Resistance of Large Diameter Piles Founded in Silty Sand", Proc. of 8th European Conf on Soil Mech & Found Eng., 1983.
Cernak, et al, "Large Diameter Bored Piles with Injected Toe in Danube Gravel", Proc. of 8th European Conf. on Soil Mech. and Found. Eng., 1983.
Mullins, "Post Grouting Drilled Shaft Tips, Phase I", Dec. 2001.
Post Grouted Drilled Shafts—Example Specification and Plan Details, Date Unknown, English translation not included.

* cited by examiner

APPARATUS AND METHOD FOR IMPROVED GROUT CONTAINMENT IN POST-GROUTING APPLICATIONS

CROSS-REFERENCE TO RELATED APPLICATIONS

This application is related to U.S. Pat. No. 6,371,698, issued Apr. 16, 2002, entitled "Post Stressed Pier"; U.S. Pat. No. 6,869,255, issued Mar. 22, 2005, entitled "Post-Stressed Pile"; and U.S. Pat. No. 6,942,429, a division of U.S. Pat. No. 6,869,255, issued Sep. 13, 2005, entitled "Post-Stressed Pile," all of which are incorporated by reference herein for all purposes.

FIELD OF THE INVENTION

The present invention relates generally to techniques for increasing the load bearing capacity of structural foundation piers and piles, and more particularly to the use of structures or devices placed beneath or within piers and piles to reliably enhance load bearing.

BACKGROUND OF THE INVENTION

Drilled shaft piers and driven piles are frequently used as deep foundations for buildings, bridges, and the like because they provide an economical alternative to other types of deep foundations. Drilled shaft piers are typically formed by excavating a cylindrical borehole in the ground and then placing reinforcing steel and fluid concrete in the borehole. Alternatively, pre-formed or pre-cast foundation elements, or piles, may be driven into the soil to form a foundation element. Driven piling may have a variety of cross-sectional shapes, including but not limited to round, square, or hexagonal. Driven piling may also include non-solid bodies (such as iron pipes).

The load bearing capacity of both drilled shaft piers and driven piles is a function of the end bearing capacity of the foundation element, which is determined by the maximum load that can be supported based on numerous factors, including the diameter of the element and the composition of the geomaterial (soil, rock, etc.), and the side bearing capacity of the structure, which is determined by the load capable of being borne by the skin friction developed between the side of the element and the geomaterial. The sum of the end bearing and side bearing capacities generally represents the total load that can be supported by the foundation element with acceptable foundation movement due to sinking or slippage.

It is known to use certain prior art techniques for enhancing end bearing capacity of a pier or pile in a variety of geomaterials, whether relatively hard or relatively soft. Particularly in relatively soft geomaterial, the end bearing capacity is low, adding little to the total load bearing capacity of the pier or pile, and in some instances may be discounted altogether in the calculation. End bearing capacity may also be diminished by soil disturbances at the bottom of the shaft, or by the inability to sufficiently clean out drilling detritus from the bottom of the shaft. To enhance the end bearing capacity in these and other situations, methods have been developed for pressure grouting the base or tip of the foundation element. In one of several methods known in the art, cement grout is injected under the base of concrete piers or piles after the foundation elements are in place and have cured. In successful standard tip grouting, the end bearing capacity of the foundation element is increased, although, in most methods, neither the resultant increase nor the absolute end bearing capacity of the foundation element can be directly measured.

Tip grouting may be rendered ineffective or economically prohibitive if the qualities of the particular geomaterial are such that the grout behaves unpredictably. For example, during the process of injecting pressurized grout below some foundation elements, particularly in clay, grout pressure has been observed to fall off or plateau despite the continued injection of grout. It is presumed in these situations that the grout has either begun to flow up the side of the shaft or travel through voids, cracks, hydro-fractures, seams, or solution channels in the geomaterial rather than filling the target grout area below the tip of the pier or pile. Similar difficulties are encountered when placing piers or piling in fractured rock or in gravel, each of which gives rise to uncontrolled and unpredictable grout flow. When any of the foregoing conditions occur, the pier or pile must be re-grouted or the grouting process must be abandoned. Re-grouting is a time-consuming and costly procedure because the grout lines must be flushed, the injected grout must be allowed to harden, and new grout must be pumped in. Re-grouting does not always solve the problem, however. Sometimes the target grout pressure is never reached, forcing a reevaluation of the project and potentially requiring the destruction or abandonment of the foundation element and the construction of additional or redundant piers or piles. Because each shaft can be very expensive to construct, one lost pier or pile may be devastating to a construction project.

Another disadvantage of using drilled shafts and piers as foundation elements not resolved with standard tip-grouting is the difficulty in determining the total load that can be supported by the foundation elements and the characteristics of the geomaterial at the bottom of the shafts. It is desirable to know this information in any construction project for both safety and planning purposes. In related U.S. Pat. Nos. 6,371,698, 6,869,255, and 6,942,429, the inventors disclose a method and apparatus for post-grouting that allows simple and convenient measurement of the end bearing and side bearing capacities of a foundation pier or pile while increasing the load bearing capacity of the foundation element. While this method has proved effective, it does not ensure containment of the grout during the post-grouting process because pressurized grout can rupture its enclosure at the tip of the pile or, if an enclosure is not used, pressurized grout can fracture the clay or other geomaterial, resulting in a loss of pressure.

Methods to contain grout in tip-grouting and post-grouting applications exist, but none of them have the advantage of being both (i) significantly adaptable to hold a wide range of grout volumes as on-site conditions dictate after the foundation element is put in place and (ii) capable of providing important data regarding the relationship between the geomaterial and the foundation element at the bottom of the pier or pile. For example, placing or installing an expandable "bellows"-type grout enclosure at the bottom of a shaft or pile is known to be used to contain grout in post-grouting applications. This type of grout enclosure, while somewhat adaptable, will contain only a limited range of grout volumes. Additionally, such a system provides no information on the strength of the geomaterial at the bottom of the shaft or the strain and movement associated with the geomaterial and the foundation element.

What is needed is a method and apparatus for containing grout in the target area below piers or piles in post-grouting applications that both ensures that the grout adequately provides support to the foundation element and provides data regarding the strength of the geomaterial at the bottom of the shaft and the strain and movement associated with the geomaterial and the foundation element.

BRIEF SUMMARY OF THE INVENTION

Accordingly, the present invention provides a piston arrangement that functions to contain injected grout beneath a foundation element in post-grouting applications while simultaneously providing a means for measuring the strength of the geomaterial below the foundation element and the strain and movement associated with the geomaterial and the pier or pile. The piston arrangement is operative to provide an effective elongation of the foundation element.

In certain embodiments, the piston arrangement consists of a cylindrical barrel with one open end and one closed end adapted so that, once a pier or pile is formed or placed in the usual manner, the bottom or base of the foundation element fits relatively snugly into the open end of the barrel. Pressurized grout may be injected via one or more conduits extending axially down the pier or pile and terminating at the base of the foundation element. In exemplary embodiments employing drilled shaft pier elements, the injected grout may fill the area between the base of the foundation element and the top surface of the closed bottom end of the barrel, exerting a downward pressure on the base of the barrel and urging the barrel down into the geomaterial, and exerting an upward pressure on the pier or pile. Grout may be pumped into the interior of the barrel until a predetermined pressure is reached or the barrel has been pushed downward to a predetermined depth in the geomaterial. In other embodiments employing driving piling with non-circular cross sections, a conforming non-cylindrical piston may be employed, to much the same effect.

This piston arrangement may be used in conjunction with a drilled shaft pier or a driven pile. In the case of a drilled shaft pier, a shaft is first drilled using any suitable technique known in the art. A barrel, preferably a cylinder with a diameter roughly the same as or slightly less than the diameter of the shaft, is placed at the bottom of the shaft so that the open end of the barrel is facing upwards towards the top of the shaft. Conduit adapted to deliver grout to the barrel from the surface and reinforcing material, such as steel reinforcing bars, may be installed into the shaft. In certain embodiments, cementitious material such as concrete may then be poured into the shaft and allowed to harden to form the pier. In the case of a driven pile foundation element, prior to driving a pile into the geomaterial, the pile is pre-fitted or pre-formed to retain grout conduit, with a barrel-shaped piston or other suitably-shaped piston secured proximate to the lower end of the pile. In general, the "barrel" will take the cross-sectional shape of the driven pile. The pile is then driven into the geomaterial according to conventional techniques known in the art that may include the use of a driving mechanism such as a pneumatic hammer or other apparatus.

A piston arrangement according to the present invention allows a wide volume range of grout to be pumped below a foundation element as determined by the particular on-site conditions while reducing the likelihood that a foundation element will need to be re-grouted or abandoned due to loss of grout containment. In addition, certain embodiments of the present invention allow for a more accurate determination of the ultimate strength of the geomaterial and a more precise calculation of the total load bearing capacity of the foundation element. For example, in certain embodiments, those skilled in the art would be able to make these determinations and calculations by determining the downward movement of the barrel into the geomaterial based on the volume of grout pumped into the barrel and the upward movement of the pier or pile measurable at the surface, if any.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. The same reference numerals are employed to designate like parts in all Figures.

DETAILED DESCRIPTION OF PREFERRED EMBODIMENTS

Figure 1:
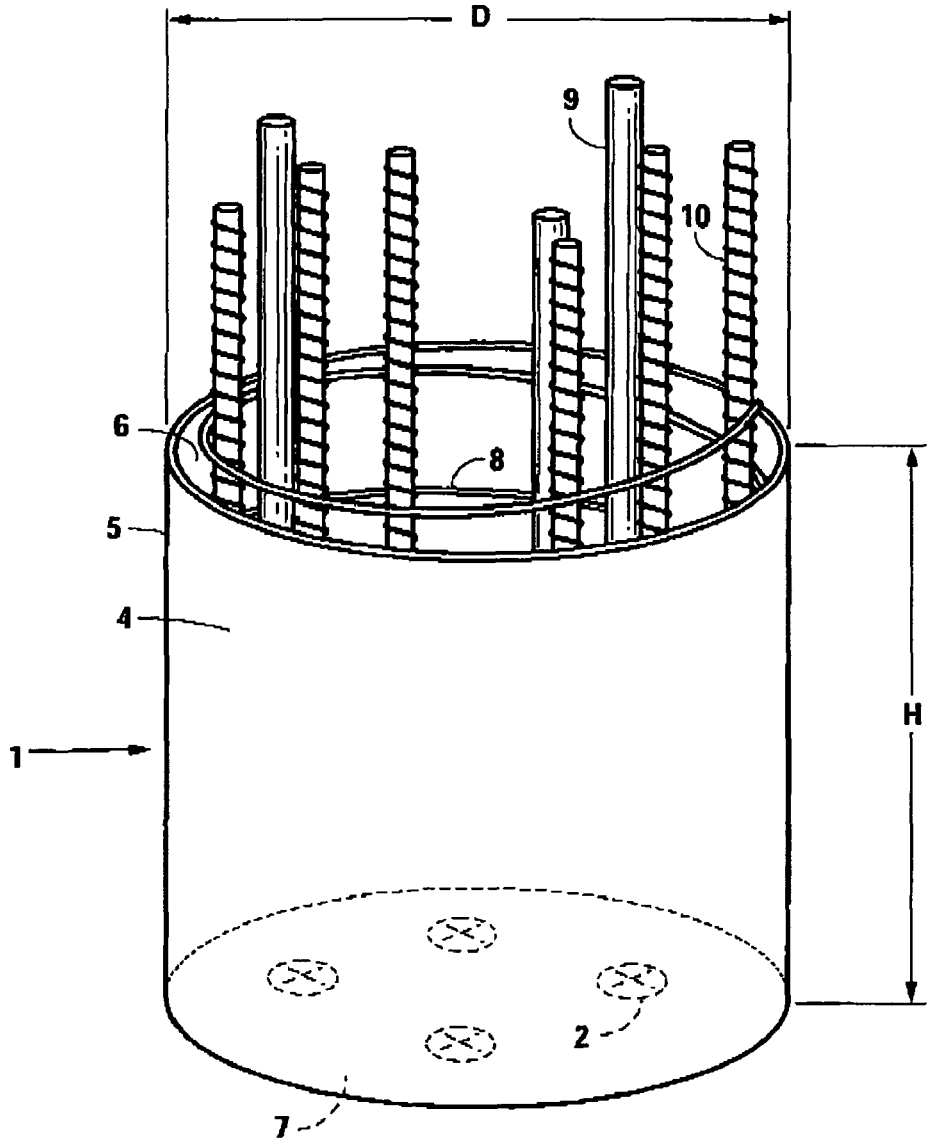
FIG. 1 depicts a barrel and sections of reinforcing material and grout conduit according to one embodiment of the present invention.

FIG. 1 shows one embodiment of a barrel 1 described in the present invention. More particularly, FIG. 1 depicts a cylindrical barrel 1 consisting of a barrel shell 4, with an outer surface 5 and an inner surface 6, a bottom plate 7 and an open top end 8. The barrel may be adapted to receive pressurized grout via conduit 9, which may be one or more pipes extending axially to the bottom plate 7 of barrel 1. The barrel may also accommodate reinforcing material 10, such as steel reinforcing bars.

The barrel 1 may be constructed out of any material capable of holding grout under pressure, preferably in the range of 100 to 1000 psi. In some embodiments, the barrel shell 4 and the bottom plate 7 are both made of metal. In other embodiments, the barrel shell 4 and the bottom plate 7 may be made out of a single piece of material, such as molded plastic or formed or cast metal. In still other embodiments, the barrel shell 4 and the bottom plate 7 may be separate pieces attached to each other by any suitable technique to form barrel 1.

The dimensions of the barrel 1 will depend upon the specific requirements of the foundation element to be post-stressed and will be apparent to those skilled in the art in light of the disclosures herein. In some embodiments the barrel 1 will be cylindrical with a diameter D roughly the same as or somewhat less than the diameter of the drilled pier shaft it is to be installed in. The height H of the barrel 1 may be equal to or greater than the diameter D of the barrel 1, but, preferably, is not less than three feet.

In embodiments employing driven piling, the cross-section of the containment component preferably confirms to the cross-sectional shape of the driven piling, but in any case should fit relatively snugly with the pile as described. Hereafter, it will be understood that the exemplary cylindrical barrel employed with drilled shaft piers may, when used with driven piling, have a different cross-section, such as would conform to the shape of the pile. By use of the term "barrel" hereafter and in our claims, we mean to encompass not only conventional cylindrical shapes, but also any containment structure having one or more substantially vertical side walls and a bottom, regardless of its horizontal cross-sectional shape.

The outer surface 5 of the barrel 1 should permit drilling fluid, which may include bentonite, and other material, to flow around the barrel 1 when it is being installed or lowered into a shaft so that minimal turbulence is exerted on the shaft walls. In some embodiments, the bottom plate 7 may include one or more one-way valves 2, such as check valves or flapper valves. Such valves 2 may facilitate installation of the barrel 1 into certain shafts where drilling fluid is used in forming the shaft. After drilling such a shaft, drilling fluid may remain and may interfere with the proper placement of the barrel 1 at the bottom of the shaft. The addition of one-way valves 2 into the bottom of the barrel permits drilling fluid to pass through the barrel 1 when it is lowered into the shaft thereby allowing the barrel 1 to be seated at the bottom of the shaft. The one-way valves 2 should be further adapted to prevent grout pumped into the barrel 1 under pressure from flowing out of the bottom plate 7 via the valves 2 so that the grout is contained within the barrel 1.

The inner surface 6 of the barrel 1 may preferably comprise or be coated with any suitable sealing material that will create a seal between the inner surface 6 and the pier 24 such that pressurized grout will be inhibited from escaping the barrel. In other embodiments employing driven piling, the sealing material may be applied to a portion of the outer surface of the pile. In either case, the material should preferably be a lubricant that facilitates downward movement of the barrel 1 relative to the pier as pressurized grout is pumped into the barrel 1. Such a lubricant may consist of or comprise materials known in the art as bond breakers, which facilitate the free relative movement of the barrel and pier in circumstances where they might tend to bind or bond. Alternatively, instead of a coating, the sealing material may be a gasket made of neoprene or other suitably flexible material to facilitate relative movement of the barrel while inhibiting outflow of pressurized grout.

Figure 2:
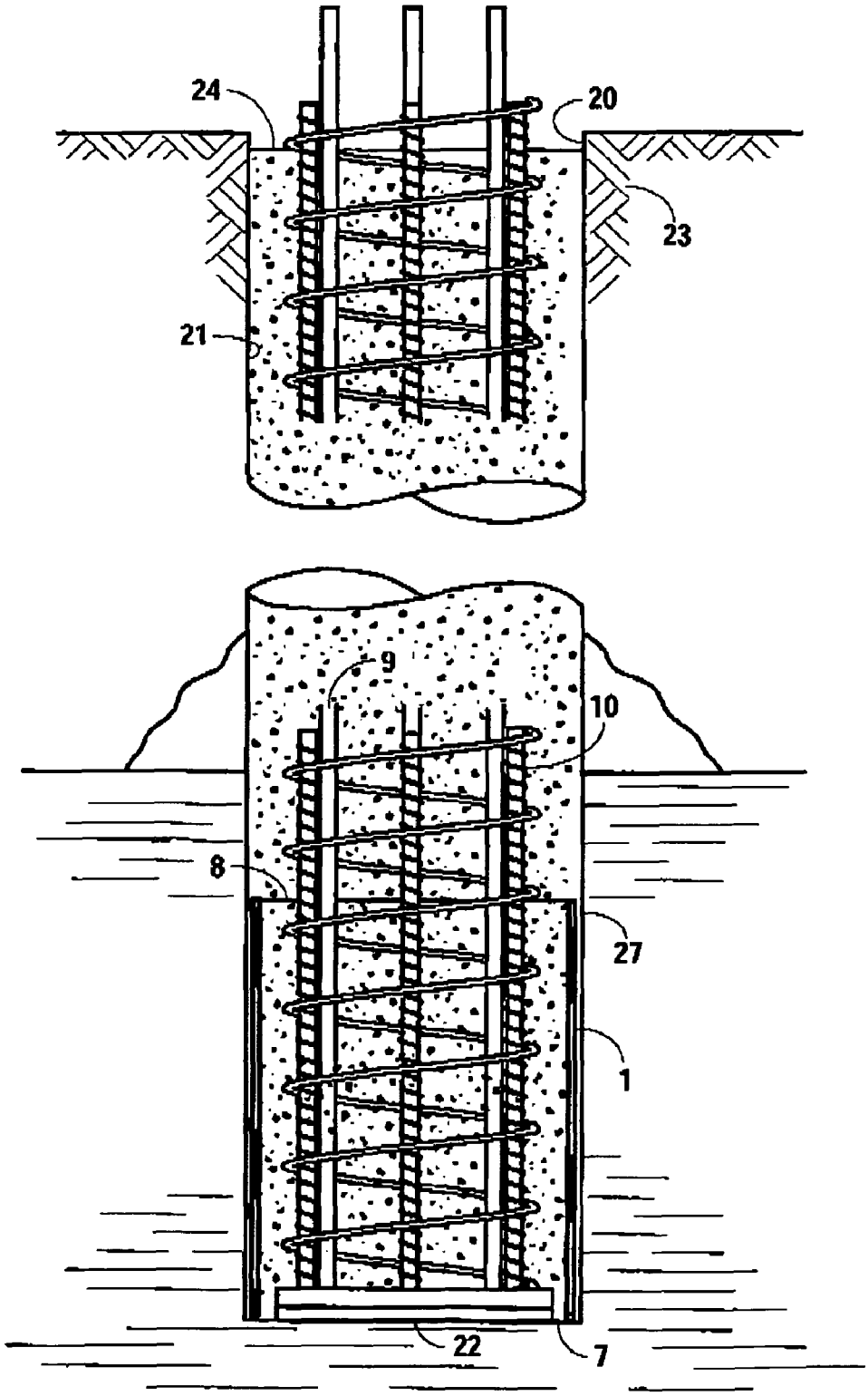
FIG. 2 is a cross sectional view of a drilled shaft pier assembly and barrel for containing grout according to one embodiment of the present invention.

FIG. 2 shows a pier assembly with a barrel 1 according to one embodiment of the present invention. Any suitable technique for producing a shaft 20 having a shaft wall 21 and a shaft floor 22 may be employed to commence construction of the pier in geomaterial 23. Pier 24, which is preferably cylindrical, may be made of cementitious material such as concrete, and may be reinforced using reinforcing material 10, such as steel reinforcing bars. Shaft wall 21 exerts skin friction against pier wall 27 commensurate with the weight of the pier and any load placed on it.

Barrel 1 is placed in the lower end of the shaft 20 before the pier 24 is poured and is situated so that the bottom plate 7 is proximate to the shaft floor 22 and the open top end 8 of the barrel 1 is facing upward. Grout conduit 9 adapted to carry grout to the barrel 1 may be installed in the shaft 20 and may consist of one or more pipes extending coaxially along the length of the pier 24. The conduit 9 may be installed so that it is in direct contact with the bottom plate 7 of the barrel 1. Reinforcing material 10 may also be installed in the shaft 20 before the pier 24 is poured.

Figure 2A:
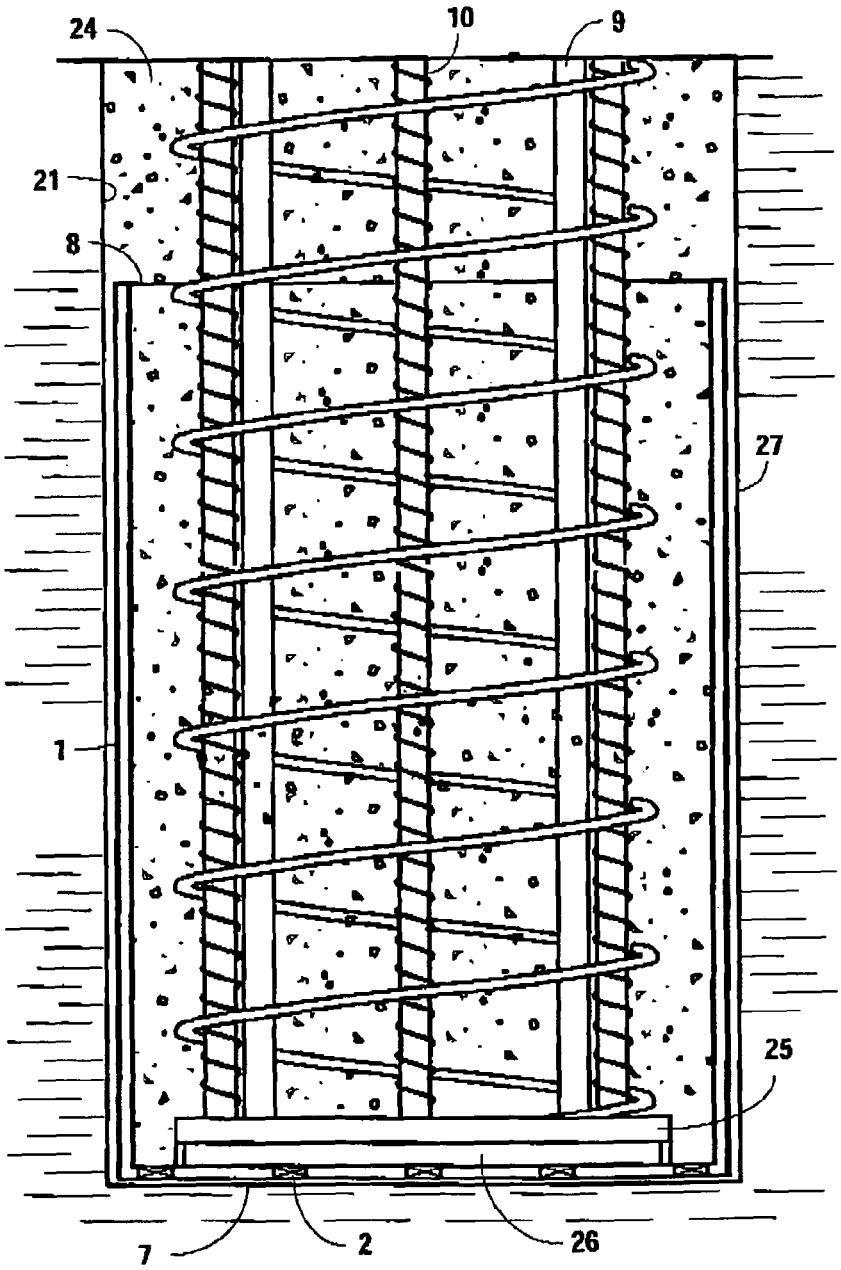
FIG. 2A is an enlarged cross-sectional view of the bottom portion of FIG. 2.

In another embodiment depicted in FIG. 2A, a spacing mechanism may be incorporated so that grout may more easily flow out of the conduit 9 into the barrel 1. The spacing mechanism may be any arrangement or mechanism for creating a space or separation between the end of the conduit 9 and the bottom plate 7 sufficient to allow pressurized grout to flow more easily out of the conduit 9 and begin filling the barrel 1. In some embodiments, such as the one shown in FIG. 2A, the spacing mechanism is a downward facing circular rimmed plate 25 which may be made out of any material capable of holding its shape and containing grout, including metal or molded plastic. Conduit 9 may be adapted to fit or couple to the back of the rimmed plate 25 and the rim of the downward facing rimmed plate 25 may be in contact with, or lightly attached to, the bottom plate 7. This creates an enclosure 26 formed by the back of the rimmed plate 25, the rim of the rimmed plate 25, and the bottom plate 7. In those embodiments where the rimmed plate 25 and the bottom plate 7 are physically attached, they should only be lightly attached, such as with tack welds or a relatively weak adhesive, so that the pressure of grout pumped into the enclosure 26 will force the rimmed plate 25 and the bottom plate 7 apart, allowing grout to fill the barrel 1. In certain embodiments, the enclosure 26 will prevent drilling fluid, cementious material used to form the pier 24, and the bottom plate 7 of the barrel 1 itself from interfering with the flow of pressurized grout pumped into the barrel 1. In other embodiments, the spacing mechanism may consist of spacers between the bottom plate 7 and a plate adapted to fit or couple to the conduit 9.

FIG. 2A further depicts one way valves 2 as described in reference to FIG. 1 above. In some embodiments, one or more valves 2 may be installed in a regular pattern throughout the bottom plate 7 of barrel 1 as depicted in FIG. 2A. Alternatively, valves 2 may be situated along the outer perimeter of the bottom plate 7 such that drilling fluid will not be permitted to enter the enclosure 26 in those embodiments where a spacing mechanism is used. In other embodiments, no valves 2 are incorporated into the barrel 1.

Figure 2B:
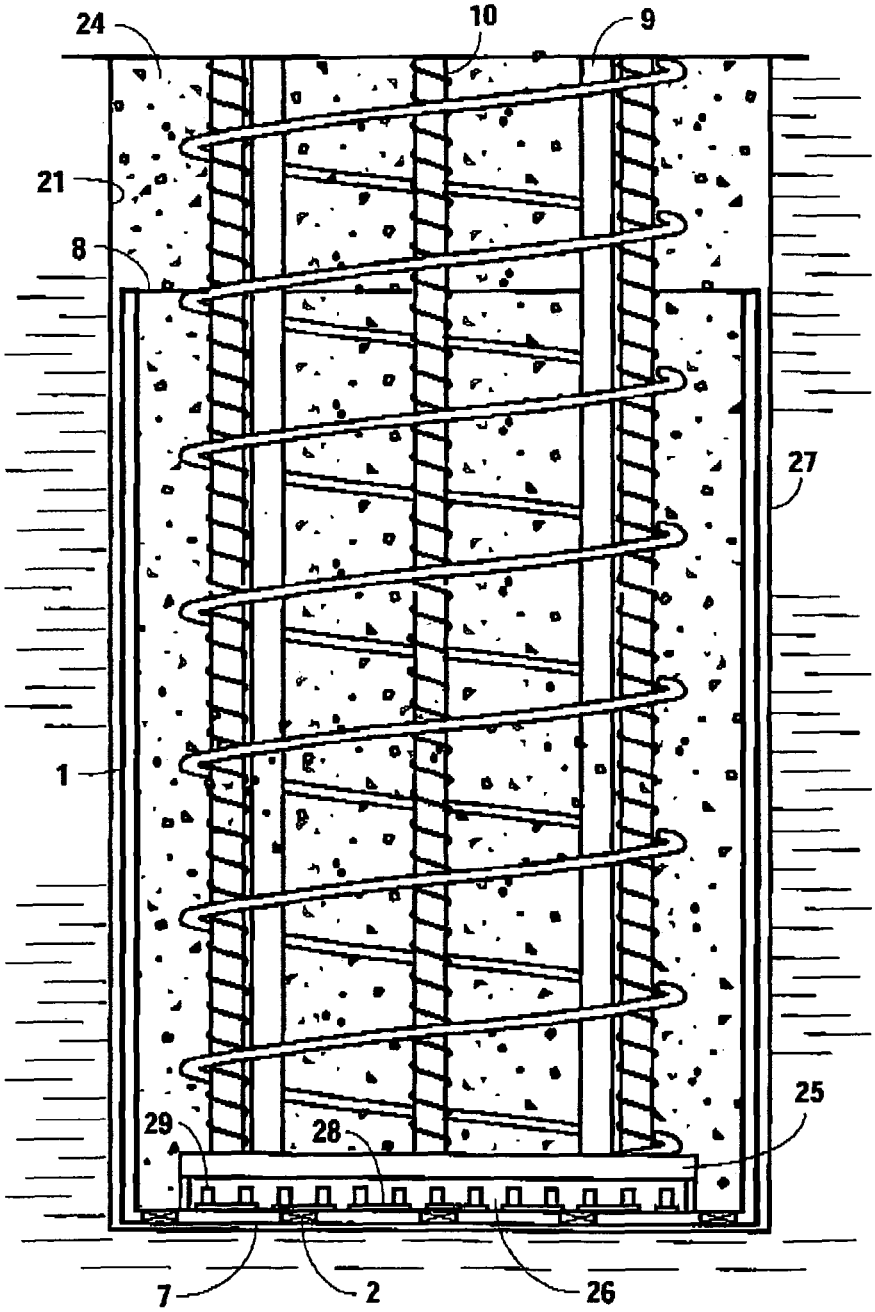
FIG. 2B is an enlarged cross-sectional view of the bottom portion of a drilled shaft pier assembly incorporating a piston arrangement and a grout diffusion device.

FIG. 2B depicts one embodiment of the present invention wherein a grout diffusion mechanism 28 is incorporated into the barrel 1. The grout diffusion mechanism 28 depicted comprises a plurality of regularly spaced cylindrical, flat-tipped cone shaped, or flat-tipped pyramid shaped protuberances 29 facing into enclosure 26. In this embodiment, the protuberances 29 may be incorporated into the bottom plate 7 of the barrel 1 or may be part of a separate piece of material, such as an injection molded plastic plate, attached to, or resting on, the bottom plate 7 of the barrel 1. The protuberances 29 function to channel pressurized grout substantially evenly in all directions throughout the enclosure 26. In some embodiments, the diffusion mechanism 28 is made in whole or in part from the three dimensional polystyrene material known commercially as Mirafi® G Series Drainage Composite, which can be modified to function as a grout diffusing material. Preferably, the Mirafi® G200N drainage composite is used, which is available from Ten Cate Geosynthetics at 365 South Holland Drive, Pendergrass, Ga. 30576. Alternatively, other methods to distribute grout familiar to those skilled in the art may be used in conjunction with the barrel 1, such as the incorporation of a three-dimensional geo-textile disc between the conduit 9 and the bottom plate 7 or the addition of a gravel bag to the barrel 1.

Figure 3:
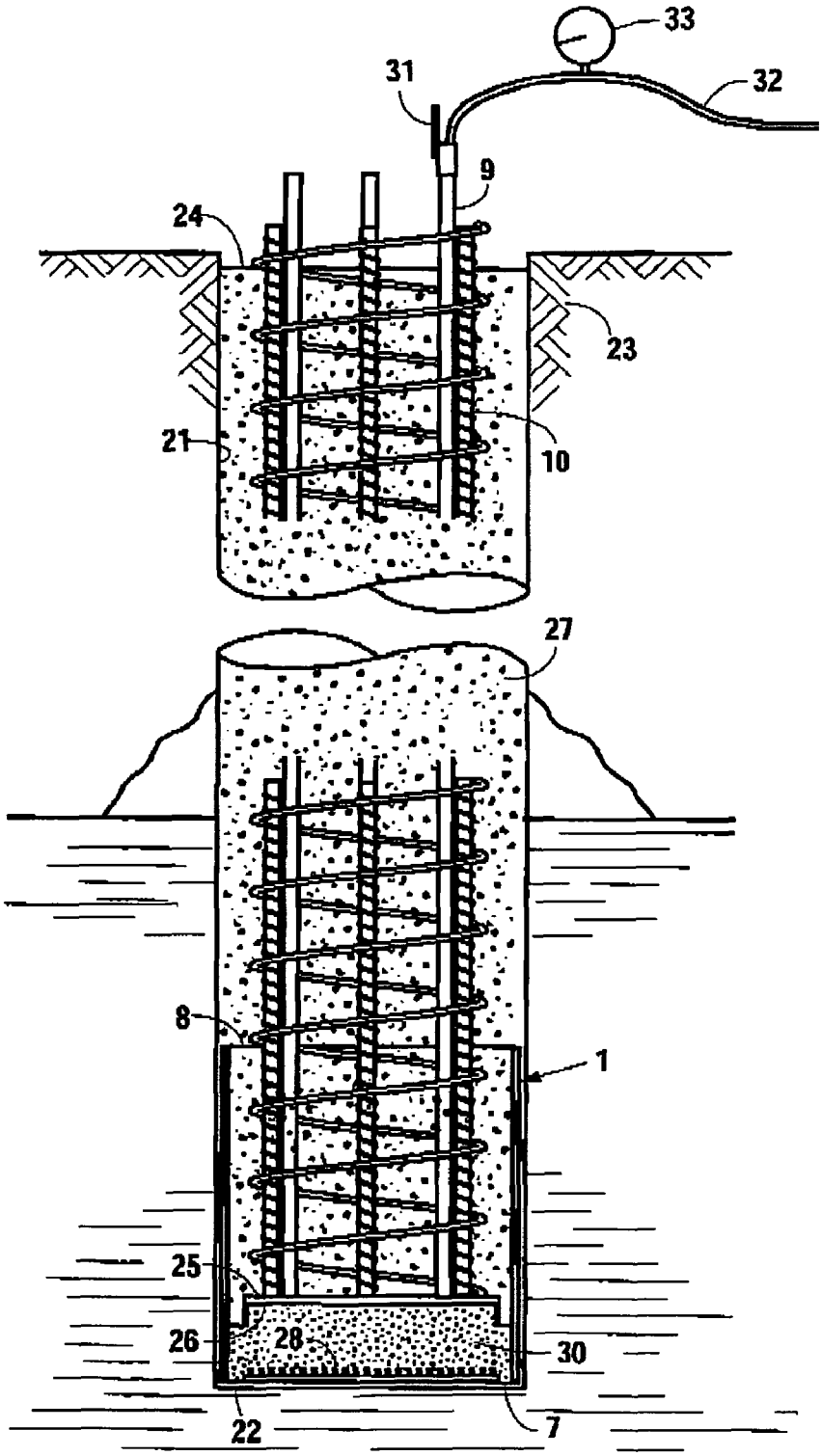
FIG. 3 is a cross-sectional view of a drilled shaft pier assembly wherein pressurized grout has been pumped into a barrel according to one embodiment of the present invention to post-base-stress the foundation element.

FIG. 3 depicts a pier 24 wherein grout 30 has been pumped into the barrel 1 according to one embodiment of the present invention. Conduit 9 is in fluid communication with a reservoir (not pictured) containing fluid grout. Upon opening valve 31, grout may be pumped from the reservoir through a hose 32 or pipe to conduit 9 and into barrel 1. The barrel 1 will keep the pressurized grout 30 contained in the target area directly under the pier 24 and the grout 30 will exert downward pressure on the barrel 1 and upward pressure on the pier 24.

The pressure of grout 30 within the barrel 1 may be measured at the surface by a pressure gauge 33. The injection of grout 30 creates a downward force exerted by the barrel 1 against the shaft floor 22, urging the barrel into the geomaterial 23, as well as an upward force against the pier 24. Grout 30 is pumped into the barrel 1 until the pressure indicated by the gauge 33 reaches a predetermined threshold, until a predetermined volume of grout 30 has been pumped into the barrel 1, or until some other predetermined criterion is reached. The measurement of the quiescent pressure in the barrel 1 obtained by the gauge 33 permits those skilled in the art to directly measure the end bearing and side bearing capacity of the resulting post-base stressed pier assembly. The closure of the valve 31 may enhance hardening of grout 30 within the barrel 1, which, in any event, will be under pressure from the weight of the column of grout in the conduit 9.

The downward movement of the barrel 1 into the geomaterial 23 may be determined from the volume of grout 30 pumped into the barrel 1 and the upward movement of the pier 24, if any, as measured at the surface. A person skilled in the art may use this information to determine the ultimate strength of the geomaterial 23 which will allow for a more precise calculation of the total load-bearing capacity of the foundation element.

Figure 3A:
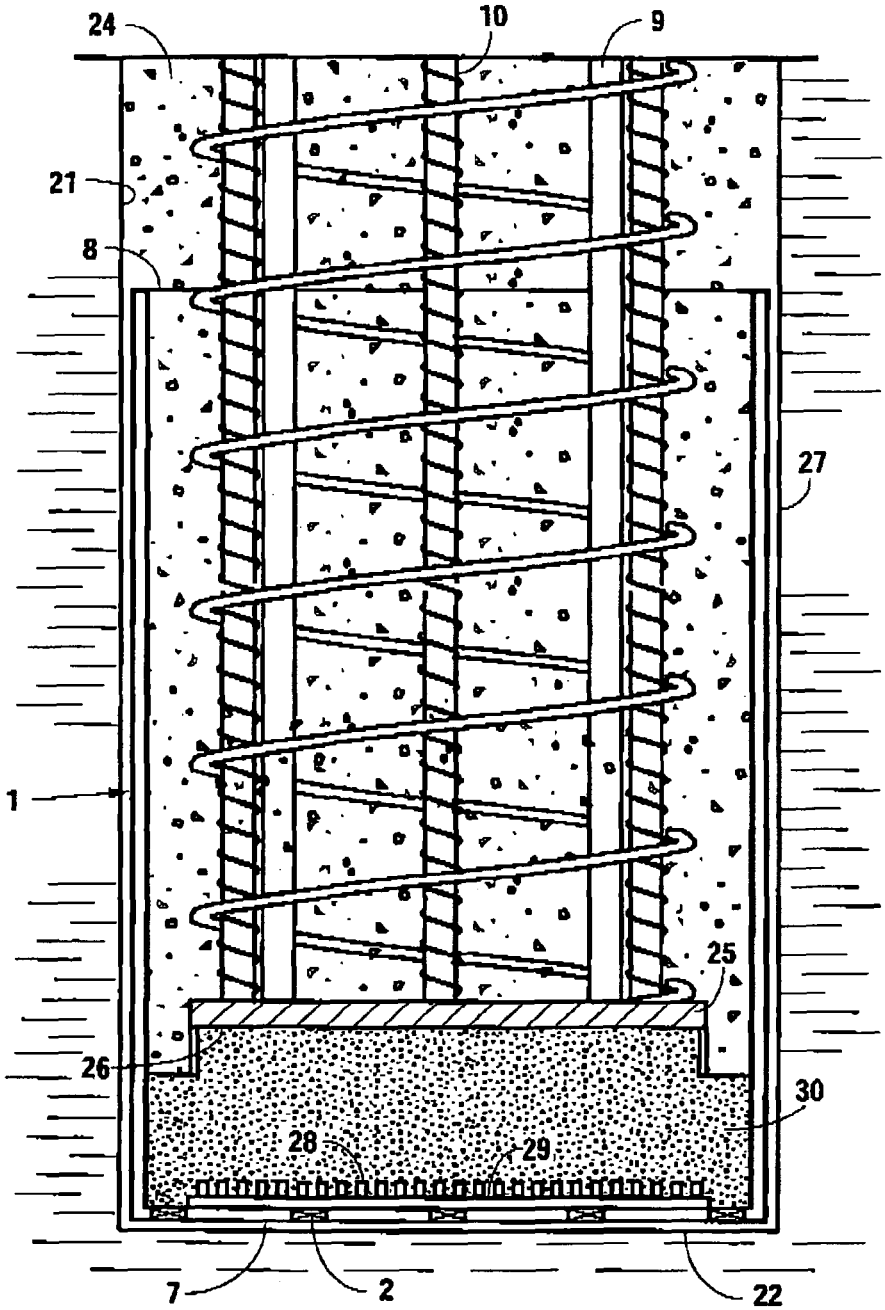
FIG. 3A is an enlarged cross-sectional view of the bottom portion of FIG. 3.

As shown in FIG. 3A, in cases where certain embodiments of spacing mechanisms are used, the grout 30 is initially pumped into the enclosure 26 formed by the rimmed plate 25 and the bottom plate 7. Grout 30 pumped through the conduit 9 will flow relatively freely into the enclosure 26, first filling the enclosure 26 and then forcing the rimmed plate 25 and the bottom plate 7 apart and exerting downward pressure on the barrel 1 and upward pressure on the pier 24 as described.

FIG. 3A further depicts a grout diffusion mechanism 28 for distributing grout evenly as described in reference to FIG. 2B above, and one way valves 2 to aid in installation of the barrel 1 as described in reference to FIG. 1 and FIG. 2A above.

While the foregoing embodiments of the present invention were illustrated in the context of a pier formed in a drilled shaft, it is understood that the present invention will provide similar advantages when a driven piling is employed as a foundation element instead. Prior to driving a pile into the geomaterial, it may be pre-fitted or pre-formed to retain grout conduit, and a form-fitting barrel, as described in the foregoing embodiments, is fit over the proximate the lower end of the pile. The pile is then driven into the geomaterial according to conventional techniques known in the art, which may include the use of a driving mechanism, such as a pneumatic hammer or other known driving apparatus.

The foregoing description of the preferred embodiments of the present invention has been presented for purposes of illustration. It is not intended to be exhaustive or to limit the invention to the precise forms disclosed. Many variations and modifications of the embodiments described herein will be apparent to one of ordinary skill in the art in light of the above description. The scope of the invention is to be defined only by the claims appended hereto.

What is claimed is:

1. A structural assembly having enhanced reliability and load bearing capacity for supporting foundations, bridges, and other loads, comprising:

a barrel having an outer surface, an inner surface, a bottom plate, and an open top, said barrel being disposed in the ground;

a foundation element disposed in said open top of said barrel and generally containing a conduit; and said barrel containing grout injected through said conduit so that said grout is contained substantially beneath said Foundation element, said barrel exerting a downward force on said ground, thereby enhancing the load bearing capacity of said structural assembly.

2. The structural assembly of claim 1 wherein said foundation element is a cementitious pier.

3. The structural assembly of claim 1 wherein said foundation element is a driven pile.

4. The structural assembly of claim 1 further comprising a spacing mechanism between said bottom plate and said conduit to facilitate the flow of said grout into said barrel.

5. The structural assembly of claim 1 wherein said barrel further comprises a grout diffusion mechanism to facilitate substantially even distribution of said grout.

6. The structural assembly of claim 1 wherein said barrel has a height approximately equal to or greater than the diameter of said barrel.

7. The structural assembly of claim 1 wherein said barrel has a height of at least three feet.

8. A structural assembly having enhanced reliability and load bearing capacity for supporting foundations, bridges, and other loads, comprising:

a barrel having an outer surface, an inner surface, a bottom plate comprising a one-way valve, and an open top, said barrel being disposed in the ground;

a foundation element disposed in said open top of said barrel;

said barrel containing grout injected through a conduit so that said grout is contained substantially beneath said foundation element, said barrel exerting a downward force on said ground, thereby enhancing the load bearing capacity of said structural assembly.

9. A structural assembly having enhanced reliability and load bearing capacity for supporting foundations, bridges, and other loads, comprising:

a barrel having an outer surface, an inner surface, a bottom plate, and an open top, said barrel being disposed in the ground;

a foundation element disposed in said open top of said barrel;

said barrel containing grout injected through a conduit so that said grout is contained substantially beneath said foundation element, said barrel exerting a downward force on said ground, thereby enhancing the load bearing capacity of said structural assembly; and a sealing material between said inner surface of said barrel and said foundation element to substantially inhibit outflow of pressurized grout from the barrel.

10. The structural assembly of claim 9 wherein said sealing material comprises a lubricant.

11. The structural assembly of claim 9 wherein said sealing material comprises a bond breaker.

12. The structural assembly of claim 9 wherein said sealing material comprises a gasket.

13. A method of enhancing the reliability and load bearing capacity of a structural cementitious pier comprising the steps of placing a barrel in a shaft formed in earthen material, said shaft having a shaft bottom and said barrel having an open top, an inner surface, an outer surface, and a bottom plate, said bottom plate being situated proximate to said shaft bottom, and said barrel being adapted to receive fluid grout through a conduit generally disposed within said barrel;

forming a cementitious pier disposed in said open end of said barrel, said pier having a pier bottom;

placing pressurized grout in said barrel between said pier bottom and said bottom plate of said barrel through said conduit so as to exert downward force against said barrel.

14. The method of claim 13 wherein said barrel further comprises a spacing mechanism to facilitate the flow of said grout into said barrel.

15. The method of claim 13 further comprising the step of diffusing the grout with a grout diffusion mechanism.

16. The method of claim 13 wherein said barrel has a height approximately equal to or greater than the diameter of said barrel.

17. The method of claim 13 wherein said barrel has a height of at least three feet.

18. A method of enhancing the reliability and load bearing capacity of a structural cementitious pier comprising the steps of:

placing a barrel in a shaft formed in earthen material, said shaft having a shaft bottom and said barrel having an open top, an inner surface, an outer surface, and a bottom plate comprising a one-way valve, said bottom plate being situated proximate to said shaft bottom, and said barrel being adapted to receive fluid grout through a conduit;

forming a cementitious pier disposed in said open end of said barrel, said pier having a pier bottom;

placing pressurized grout in said barrel between said pier bottom and said bottom plate of said barrel through said conduit so as to exert downward force against said barrel.

19. A method of enhancing the reliability and load bearing capacity of a structural cementitious pier comprising the steps of placing a barrel in a shaft formed in earthen material, said shaft having a shaft bottom and said barrel having an open top, an inner surface, an outer surface, and a bottom plate, said bottom plate being situated proximate to said shaft bottom, and said barrel being adapted to receive fluid grout through a conduit;

forming a cementitious pier disposed in said open end of said barrel, said pier having a pier bottom;

placing pressurized grout in said barrel between said pier bottom and said bottom plate of said barrel through said conduit so as to exert downward force against said barrel;

wherein said inner surface of said barrel is provided with a sealing material to substantially inhibit pressurized grout from flowing between said inner surface of said barrel and said pier.

20. The method of claim 19 wherein said sealing material comprises a lubricant.

21. The method of claim 19 wherein said sealing material comprise a bond breaker.

22. The method of claim 19 where said sealing material comprises a gasket.

23. A method of enhancing the reliability and load bearing capacity of a structural driven pile having a top end and a bottom end, comprising the steps of:

fitting said bottom end of said pile into an open top of a barrel, said barrel having an inner surface, an outer surface, a bottom plate, and said open top, and said barrel being adapted to receive fluid grout through a conduit;

driving said pile into earthen material; and placing pressurized grout in said barrel between said bottom end of said pile and said bottom plate of said barrel through said conduit so as to exert downward force against said barrel.

24. The method of claim 23 wherein said bottom plate of said barrel further comprises a one-way valve.

25. The method of claim 23, further comprising the step of placing a sealing material between said inner surface of said barrel and said pile to substantially inhibit outflow of pressurized grout from the barrel.

26. The method of claim 25 wherein said sealing material comprises a lubricant.

27. The method of claim 25 wherein said sealing material comprises a bond breaker.

28. The method of claim 25 wherein said sealing material comprises a gasket.

29. The method of claim 23 wherein said outer surface of said barrel is coated with a lubricating material.

30. The Method of claim 23 wherein a portion of said pier is coated with a lubricating material.

31. The method of claim 23 wherein said barrel further comprises a spacing mechanism to facilitate the flow of said grout into said barrel.

32. The method of claim 23 further comprising the step of diffusing the grout with a grout diffusion mechanism.

33. The method of claim 23 wherein said barrel has a height approximately equal to or greater than the diameter of said barrel.

34. The method of claim 23 wherein said barrel has a height of at least three feet.

* * * * *